US008588673B2

(12) United States Patent
Hayakawa et al.

(10) Patent No.: US 8,588,673 B2
(45) Date of Patent: Nov. 19, 2013

(54) CONVEYING DEVICE AND IMAGE-FORMING APPARATUS

(75) Inventors: Yuji Hayakawa, Saitama (JP); Shinichi Kamimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 639 days.

(21) Appl. No.: 12/759,201

(22) Filed: Apr. 13, 2010

(65) Prior Publication Data

US 2011/0070008 A1 Mar. 24, 2011

(30) Foreign Application Priority Data

Sep. 18, 2009 (JP) ..... 2009-216966

(51) Int. Cl.
*B65H 1/04* (2006.01)
*B65H 3/24* (2006.01)
*G03G 15/00* (2006.01)

(52) U.S. Cl.
USPC ..... 399/393; 271/126; 271/127

(58) Field of Classification Search
USPC ..... 399/393; 271/126, 127
See application file for complete search history.

(56) References Cited

U.S. PATENT DOCUMENTS

| | | | | |
|---|---|---|---|---|
| 4,319,740 | A * | 3/1982 | Ulseth | 271/22 |
| 5,815,787 | A * | 9/1998 | Crayton et al. | 399/393 |
| 6,341,774 | B1 * | 1/2002 | Ueda | 271/119 |
| 6,443,445 | B1 * | 9/2002 | Bortolotti | 271/117 |
| 7,270,323 | B2 * | 9/2007 | Somemiya | 271/127 |
| 7,270,373 | B2 | 9/2007 | Sakumoto | |
| 7,364,152 | B2 * | 4/2008 | Suwa | 271/118 |
| 8,116,673 | B2 * | 2/2012 | Yoon et al. | 399/393 |
| 2005/0196210 | A1 * | 9/2005 | Suzuki et al. | 399/388 |
| 2005/0236760 | A1 * | 10/2005 | Kang | 271/152 |
| 2005/0286947 | A1 * | 12/2005 | Kitamura | 399/393 |

FOREIGN PATENT DOCUMENTS

| | | | |
|---|---|---|---|
| JP | 01081726 | A * | 3/1989 |
| JP | 05301644 | A * | 11/1993 |
| JP | 06227684 | A * | 8/1994 |
| JP | 11130276 | A * | 5/1999 |
| JP | A-2002-119091 | | 4/2002 |
| JP | B2-3428796 | | 7/2003 |
| JP | B2-3530513 | | 5/2004 |
| JP | A-2008-8335 | | 1/2008 |
| JP | B2-4218509 | | 2/2009 |

OTHER PUBLICATIONS

Notice of Reasons for Rejection dated Sep. 3, 2013 from Japanese Patent Application No. 2009-216966 (with English-language translation).

* cited by examiner

*Primary Examiner* — Judy Nguyen
*Assistant Examiner* — Nguyen Q Ha
(74) *Attorney, Agent, or Firm* — Oliff & Berridge, PLC

(57) ABSTRACT

A conveying device includes a support member that supports a conveyed medium; a rotation member that is rotated by a drive unit, the rotation member having a contact surface for contacting the conveyed medium supported by the support member to cause the conveyed medium to move on a rotation of the rotation member; a position-changing unit that changes a position of the support member in accordance with the rotation of the rotation member from a first position where the conveyed medium does not contact the contact surface to a second position where the conveyed medium contacts the contact surface; and a buffer mechanism that allows movement of the position-changing unit or the support member in a direction opposite to a direction of the position change of the support member from the first position to the second position caused by the position-changing unit.

2 Claims, 6 Drawing Sheets

CONVEYING DEVICE AND IMAGE-FORMING APPARATUS

CROSS-REFERENCE TO RELATED APPLICATIONS

This application is based on and claims priority under 35 U.S.C. 119 from Japanese Patent Application No. 2009-216966, which was filed on Sep. 18, 2009.

BACKGROUND

1. Technical Field

The present invention relates to a conveying device and an image-forming apparatus.

2. Related Art

A technique for conveying a sheet is disclosed in U.S. Pat. No. 7,270,323, for example.

SUMMARY

In one aspect of the present invention, there is provided a conveying device comprising a support member that supports a conveyed medium; a rotation member that is rotated by a drive unit, the rotation member having a contact surface for contacting the conveyed medium supported by the support member to cause the conveyed medium to move on a rotation of the rotation member; a position-changing unit that changes a position of the support member in accordance with the rotation of the rotation member from a first position where the conveyed medium does not contact the contact surface to a second position where the conveyed medium contacts the contact surface; and a buffer mechanism that allows movement of the position-changing unit or the support member in a direction opposite to a direction of the position change of the support member from the first position to the second position caused by the position-changing unit.

BRIEF DESCRIPTION OF THE DRAWINGS

Exemplary embodiments of the present invention will be described in detail based on the following figures, wherein.

DETAILED DESCRIPTION

[First Exemplary Embodiment]

Figure 1:
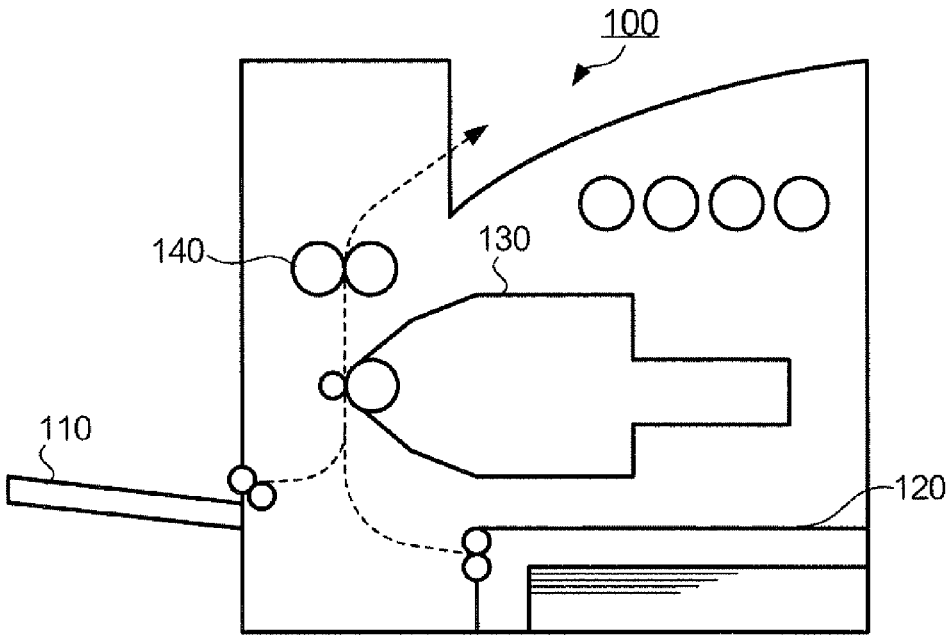
FIG. 1 shows a configuration of an image-forming apparatus according to a first exemplary embodiment of the invention.

FIG. 1 shows the configuration of an image-forming apparatus according to a first exemplary embodiment of the present invention. As shown in FIG. 1, image-forming apparatus 100 of this exemplary embodiment includes first conveying unit 110, second conveying unit 120, transfer unit 130, and fixation unit 140. Further, image-forming apparatus 100 is provided with a control unit (not shown in the drawing) for controlling the operation of these units. Image-forming apparatus 100 of this exemplary embodiment is of an electrophotography-type.

First conveying unit 110 embodies a conveying device of the present invention in this exemplary embodiment, and serves to supply a recording medium through manual feeding. It is to be noted here that the recording medium is an example of a conveyed medium relating to the present invention, and indicates a sheet-shaped member having a predetermined shape and size. As a recording medium, a rectangular sheet of paper (often merely referred to as a sheet) may be used, but a medium of another material, such as a sheet of plastic, may also be used. The recording medium is conveyed in image-forming apparatus 100 along a path shown by a broken-line in a direction indicated by an arrow in FIG. 1, and an image is recorded thereon. First conveying unit 110 supplies recording media one sheet at a time to transfer unit 130.

Second conveying unit 120 serves to accommodate and supply recording media. First and second conveying units 110, 120 can be selectively used depending on a type (size, thickness, surface texture, etc.) and/or use of the recording media. Also, they may be used, for example, to first form an image on one side (front side) of a recording medium supplied from second conveying unit 120, and thereafter to manually feed the recording medium through first conveying unit 110 to form an image on the other side (back side) of the recording medium.

Transfer unit 130 transfers toner, which is an example of a color material, onto the recording medium supplied from and conveyed by first conveying unit 110 or second conveying unit 120. Transfer unit 130 includes, for example, a photosensitive drum adapted to change an electric potential according to light irradiated thereon, an exposure unit for irradiating light on the photosensitive drum to form an electrostatic latent image, a development unit for providing a toner to the electrostatic latent image formed on the photosensitive drum, a transfer member for transferring the toner on the photosensitive drum to the recording medium, and so on. The number of toner colors transferred onto the recording medium may be one or more than one. Fixation unit 140 applies heat and pressure to the toner transferred onto the recording medium, thereby to fixate the toner on the recording medium. As a result of fixation of toner on the recording medium, an image is formed on the recording medium.

Thus, transfer unit 130 and fixation unit 140 cooperatively operate to serve as an image-forming unit in this exemplary embodiment.

Figure 2:
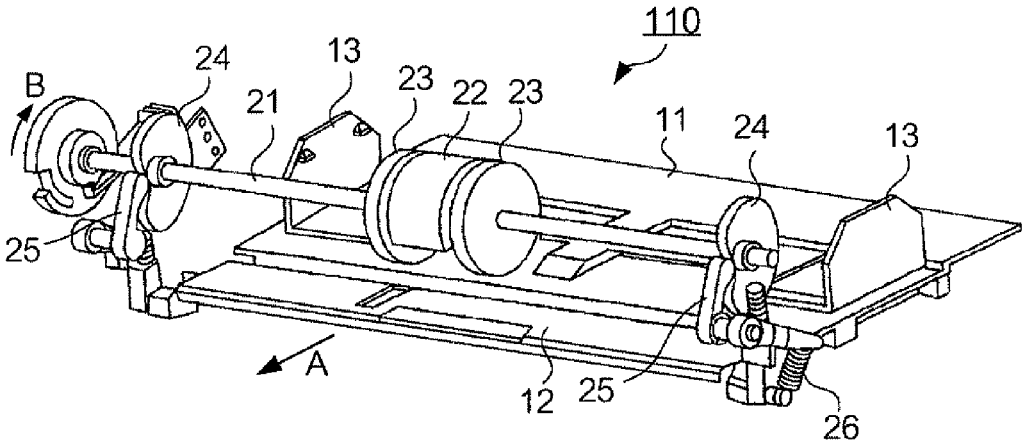
FIG. 2 is a perspective view showing a configuration of a first conveying unit of the image-forming apparatus shown in FIG. 1

FIG. 2 is a perspective view showing the configuration of first conveying unit 110. In this drawing, the direction of conveying of the recording medium is indicated by arrow A. As shown in FIG. 2, first conveying unit 110 includes plate-shaped members 11, 12, guide members 13, a shaft 21, a feed member (or feed roll) 22, auxiliary members (or auxiliary rolls) 23, cam members 24, lever members 25, and coil springs 26.

For convenience of explanation, in the following description, it is assumed that the recording medium is rectangular, and a size of the recording material in a direction of conveying of the recording medium will be referred to as a "length" and a size of the same in a direction perpendicular to the conveying direction will be referred to as a "width." Further, the direction in which plate-shaped member 12 moves closer to feed member 22 will be referred to as an "upward direction" while the direction in which plate-shaped member 12 moves away from feed member 22 will be referred to as a "downward direction," but this should not be interpreted as limiting the orientation of first conveying unit 110 in use.

Plate-shaped members 11, 12 serve to support the recording media. The recording media are placed on an upper side (as viewed in FIG. 2) of plate-shaped members 11, 12. Plate-shaped member 12 is an example of a support member and is configured to be moveable in upward and downward directions with respect to plate-shaped member 11. Thus, plate-shaped member 12 can change its position in response to an external action applied thereon. Guide members 13 are attached to plate-shaped member 11 so as to be moveable in a widthwise direction, that is, a direction perpendicular to that of conveying of the recording medium. Guide members 13 may be adjusted by a user to appropriate positions depending on the size of the recording media, thereby to guide the movement of a recording medium being conveyed and prevent a widthwise movement (or inadvertent positional shift) of the same.

It should be noted that the shape of the support member of this exemplary embodiment may be any shape, so long as the support member can support the recording medium, and thus is not limited to the plate-like shape. For example, the support member may be formed with a part similar to the above-described guide members 13 for preventing inadvertent positional shift of the recording medium.

Shaft 21 is an example of a shaft member, and is constituted of a rod-shaped member that is rotated by a drive unit (not shown in the drawing) when a recording medium is supplied. The direction of rotation of shaft 21 is indicated by arrow B in FIG. 2. Feed member 22 and each cam member 24 are configured to rotate with the rotation of shaft 21 (i.e., they are adapted to rotate in conjunction with shaft 21), whereas auxiliary members 23 are attached to shaft 21 so as to be rotatable relative to shaft 21 so that in certain cases they do not rotate with the rotation of shaft 21. Thus, in a case where a force (such as a frictional force) is applied to auxiliary members 23 preventing their rotation, auxiliary members 23 do not rotate together with the rotation of shaft 21.

Feed member 22 is a member having a partially cut-away circular shape as viewed in an axial direction, and fixed on shaft 21 to rotate with shaft 21. Feed member 22 is an example of a rotation member.

Figure 3A:
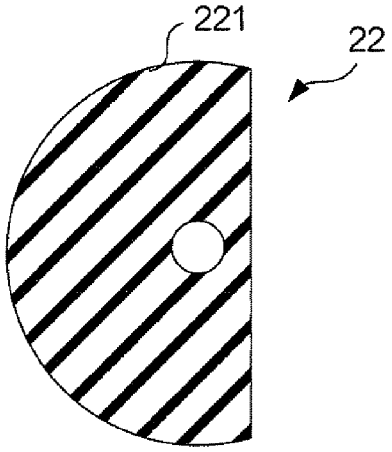
FIG. 3 shows a feed member viewed in an axial direction.
Figure 3B:
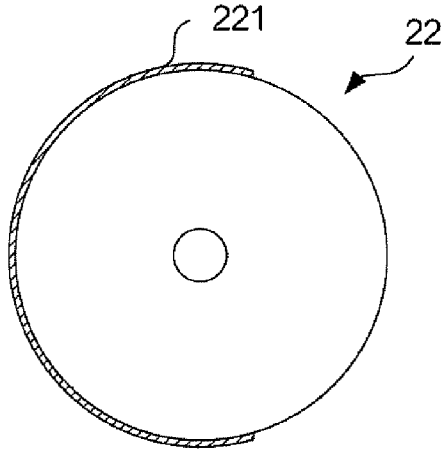

FIG. 3A shows feed member 22 as viewed in the axial direction. As shown in this drawing, feed member 22 has an arcuate portion (or "arc" portion) and a straight-line portion (or "chord" portion), and the arc portion serves as contact surface 221 that contacts the recording medium. Feed member 22 is formed of a material that, when contact surface 221 thereof is in contact with a recording medium, can create a frictional force larger than a frictional force that would be generated between two recording media stacked together. The material of feed member 22 may be rubber, for example. It is to be noted that an entire part of feed member 22 does not have to be made of rubber, but instead, a rubber sheet may be attached to a portion of feed member 22 made of a low-friction material, such that the attached rubber sheet serves as contact surface 221. In such a case, as shown in FIG. 3B, feed member 22 may be of a circular shape without a cut-away portion, and contact surface may be embodied by a rubber sheet attached to a selected portion of a circumferential surface of feed member 22.

Cam members 24 function to convert the rotational motion of shaft 21 into a reciprocal movement (or up-down movement) of plate-shaped member 12. An outer profile of each cam member 24 has at least a first portion and a second portion: in the first portion, the distance from shaft 21 to the outer surface of cam member 24 is relatively small and in the second portion, the distance from shaft 21 to the outer surface of cam member 24 is relatively large. In the following description, the first portion will be referred to as a "smaller diameter portion," and the second portion will be referred to as a "larger diameter portion." Cam members 24 are provided at positions corresponding to widthwise ends of plate-shaped member 12, one for each end. It should be noted, however, that cam member 24 may be provided at only one end of plate-shaped member 12 if the up-down movement of plate-shaped member 12 can be achieved without any problem.

Lever members 25 are adapted to contact the outer circumference of cam members 24 so as to change their posture along with the rotation of cam members 24. Lever members 25 constitute a part of a position-changing unit, and in this exemplary embodiment, include a buffer mechanism relating to the present invention. Each lever member 25 is constituted of a combination of cam follower 251 and arm 252, and the buffer mechanism is embodied as a connection structure between these component parts. Lever member 25 is an example of a position-changing member.

Figure 4:
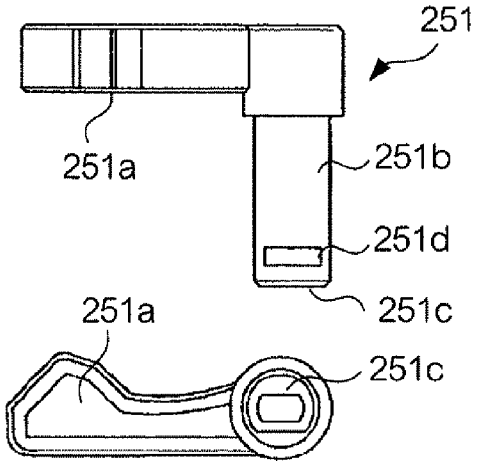
FIG. 4 shows a configuration of a cam follower.

FIG. 4 shows the structure of cam follower 251. As shown, cam follower 251 has contact portion 251*a* for contacting cam member 24, and shaft portion 251*b*. Shaft portion 251*b* functions as a rotation shaft of lever member 25. Further, shaft portion 251*b* has a tip portion 251*c* for connection with arm 252. Tip portion 251*c* has a partially cut-away circular shape when viewed in an axial direction. Also, tip portion 251*c* is formed with a recess 251*d* into which a later-described protrusion 252*d* of arm 252 is fitted. Cam follower 251 is an example of a cam contact member.

Figure 5:
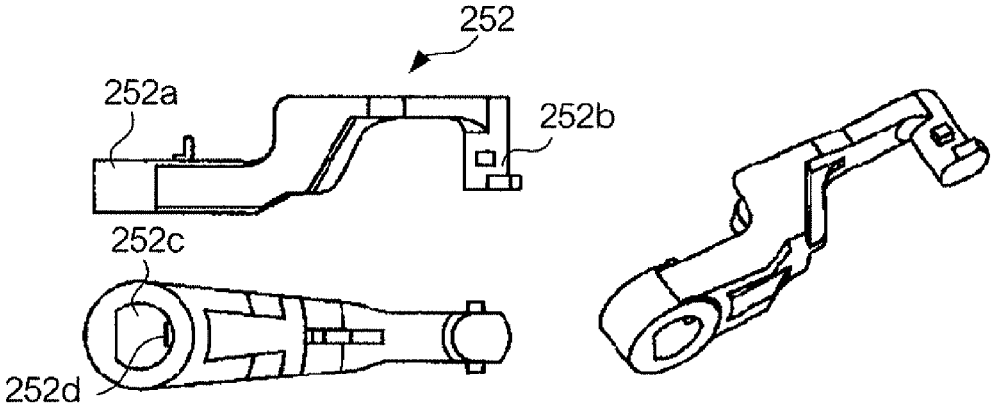
FIG. 5 shows a configuration of an arm.

FIG. 5 shows the configuration of arm 252. Arm 252 has first end portion 252*a* for connection with tip portion 251*c* of cam follower 251, and second end portion 252*b* to which coil spring 26 is attached. First end portion 252*a* is formed with hole 252*c* into which tip portion 251*c* is inserted. Further, projection 252*d* is formed in hole 252*c* so that projection 252*d* fits in recess 251*d* of cam follower 251. It is to be noted that to allow rotational movement of arm 252, projection 252*d* has a smaller size than recess 251*d* in the direction of rotation of arm 252.

Coil spring 26 has one end attached to arm 252 and the other end attached to plate-shaped member 12. Coil spring 26 is a so-called tension spring and when stretched to a length greater than a predetermined length, produces an elastic force to bring coil spring 26 back to its original length. Coil spring 26 serves to change the position of plate-shaped member 12 in accordance with a position change of arm 252. Coil spring 26 is an example of an elastic member, and operates in cooperation with lever member 25 to serve as a position-changing unit.

The configuration of image-forming apparatus 10 of this exemplary embodiment has been explained above. With such a configuration, image-forming apparatus 10 controls first conveying unit 110 or second conveying unit 120 to supply a recording medium in accordance with an image-forming timing. To supply a recording medium, first conveying unit 110 operates as follows.

Figure 6A:
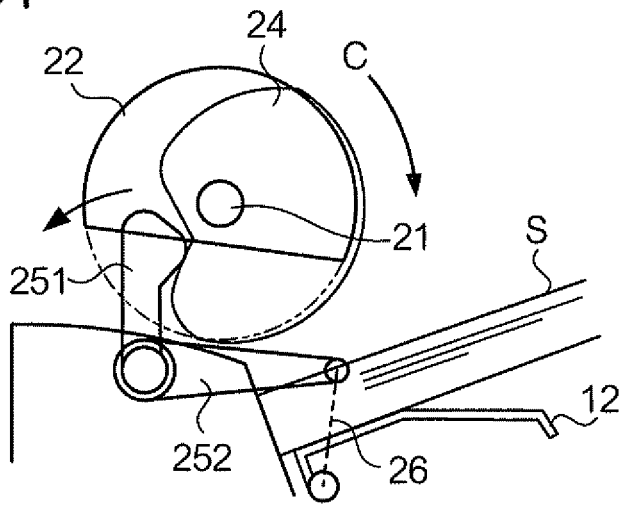
FIGS. 6A-6C show a motion of a feed member, a cam member, a lever member, and a plate-shaped member in supplying of a recording material.
Figure 6B:
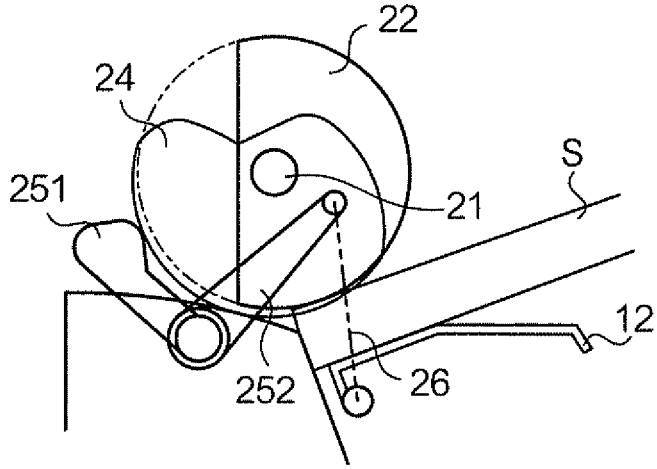
Figure 6C:
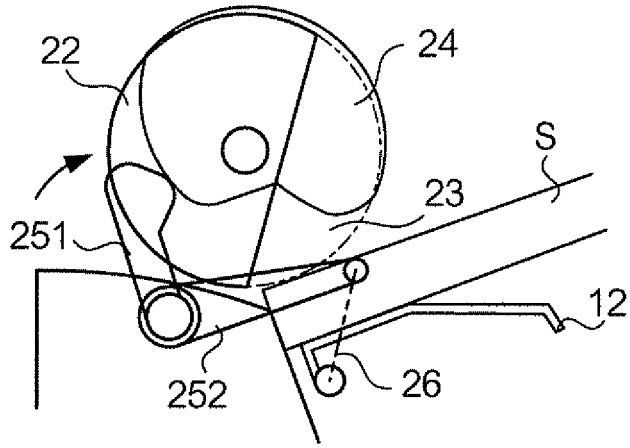

FIGS. 6A-6C show the position change of feed member 22, cam member 24, lever member 25, and plate-shaped member 12 when supplying of a recording medium is conducted. FIG. 6A shows a state where cam follower 251 is in contact with the smaller diameter portion of cam member 24, FIG. 6B shows a state where cam follower 251 is in contact with the larger diameter portion of cam member 24, and FIG. 6C is an intermediate state between the states shown in FIGS. 6A and 6B.

In the state shown in FIG. 6A, plate-shaped member 12 is placed at a position where recording media S supported on top of plate-shaped member 12 do not contact supplying member 22 (this position of plate-shaped member 12 will be referred to as a "non-conveying position" hereinafter). The non-conveying position of plate-shaped member 12 is determined according to the maximum number of recording media that can be placed on plate-shaped member 12. That is, the non-conveying position of plate-shaped member 12 is determined as a position at which even if a predetermined maximum number of recording media are placed on plate-shaped member 12, the uppermost recording medium does not contact supplying member 22. In this state, cam follower 251 of lever member 25 is in contact with the smaller diameter portion of cam member 24.

If shaft 21 rotates in a direction indicated by arrow C in FIG. 6A, the state of first conveying unit 110 changes from that shown in FIG. 6A to that shown in FIG. 6B. In the state shown in FIG. 6B, cam follower 251 of lever member 25 contacts the larger diameter portion of cam member 24, and during the state change, cam follower 251 is rotated in a direction opposite to the direction of rotation of shaft 21. As a result of this rotation of cam follower 251, second end portion 252*b* of arm 252 is moved upward, causing coil spring 26 to extend with respect to the state shown in FIG. 6A. The extension of coil spring 26 generates an elastic force that urges coil spring 26 to return to its original length, and this elastic force causes plate-shaped member 12 to move upward.

The position of feed member 22 is adjusted such that when plate-shaped member 12 is moved upward, contact surface 221 of feed member 22 is opposed to recording media S. If plate-shaped member 12 has moved to a position where recording media S and contact surface 221 contact each other (this position of plate-shaped member 12 will be referred to as "conveying position" hereinafter), plate-shaped member 12 becomes unable to move further upward. The conveying position can vary depending on the number of recording media S supported on plate-shaped member 12. When a relatively large number of sheets of recording media S are supported and hence the total thickness of recording media S is large, the conveying position is lower compared with the case where the total thickness of recording media S is small.

In the state where plate-shaped member 12 is at the conveying position, an upper surface of the uppermost sheet of recording media S supported by plate-shaped member 12 is in contact with contact surface 221. Upon rotation of feed member 22, contact surface 221 separates the uppermost sheet of recording media S from the rest, and feeds it. Thus, contact surface 221 carries out the feeding of the recording medium using a frictional force.

Contact surface 221 is provided on only a part of the outer circumference of feed member 22. Therefore, further rotation of shaft 21 leads to a state in which recording media S are no longer in contact with but are spaced apart from contact surface 221, as shown in FIG. 6C. In this state, recording media S are in contact with auxiliary member 23, which is shown by a long-dashed double-dotted line in the drawing. When in contact with recording media S, auxiliary member 23 does not rotate and holds recording media S in position to prevent inadvertent feeding of the same. During the change from the state shown in FIG. 6B to the state shown in FIG. 6C, rotation of cam member 24 causes lever member 25 to rotate such that second end portion 252*b* of arm 252 moves downward. When lever member 25 moves further to the position shown in FIG. 6A where cam follower 251 contacts the smaller diameter portion of cam member 24, plate-shaped member 12 is moved to the non-conveying position. First conveying unit 110 repeats the above operations to supply sheets of the recording media S successively at appropriate timings.

Figure 7:
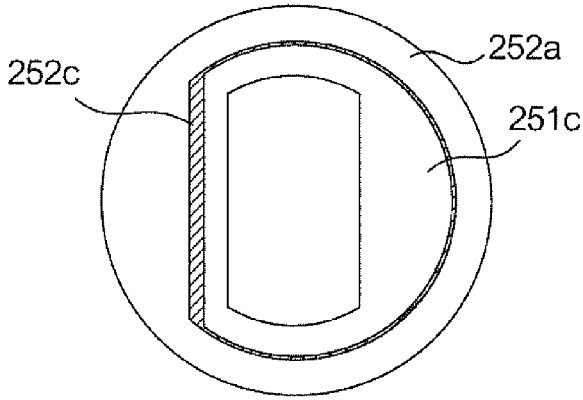
FIG. 7 shows a connection between the cam follower and the arm.

FIG. 7 shows the connection between cam follower 251 and arm 252. As shown, hole 252*c* of arm 252 has a larger size than tip portion 251*c* inserted thereinto, such that a clearance is formed between hole 252*c* and tip portion 251*c* in the state where tip portion 251*c* has been inserted into hole 252*c*. Specifically, the clearance is created along the straight-line portion (or "chord" portion) of otherwise circular hole 252*c* to allow a rotational movement of arm 252 about shaft portion 251*b* within a predetermined range. Such a structure constituted by a combination of tip portion 251*c* and hole 252*c* achieves a buffer mechanism in this exemplary embodiment.

Figure 8A:
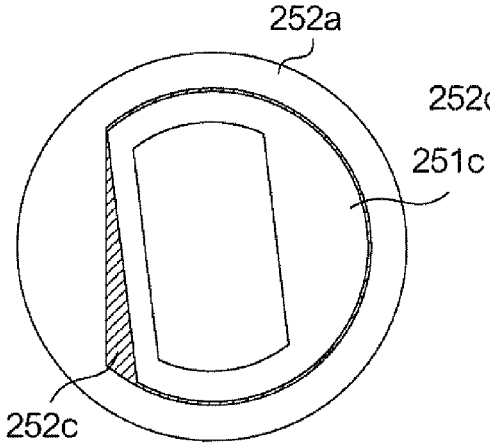
FIGS. 8A and 8B show a range of relative movement between the cam follower and the arm allowed by a buffer mechanism.
Figure 8B:
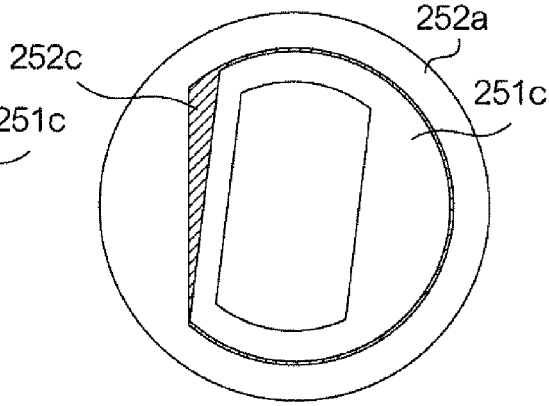

FIGS. 8A and 8B show a range of relative positional changes between arm 252 and cam follower 251 allowed by the buffer mechanism of this exemplary embodiment. Arm 252 can change its position relative to cam follower 251 from the position shown in FIG. 5A to the position shown in FIG. 8B. The buffer mechanism of this exemplary embodiment allows rotational movement of arm 252 relative to cam follower 251 within a range from 5 to 15 degrees, and preferably within a range from 5 to 10 degrees. In other words, the buffer mechanism of the present exemplary embodiment provides some "play" to tolerate rotational movement of arm 252 within the above range. The range of play is preferably determined based on an amount of force urging plate-shaped member 12 upward (such as the force exerted by coil spring 26 to move plate-shaped member 12 upward). For example, if the force urging plate-shaped member 12 upward is large, it is preferred to set a larger range of play and if the force urging plate-shaped member 12 upward is small, it is preferred to set a smaller range of play.

When, as a result of movement of plate-shaped member 12 and recording media S toward feed member 22, recording media S are brought into contact with contact surface 221, arm 252 is able to move within the above-described range of play in a direction opposite to the direction of movement before the contact between recording media S and contact surface 221 took place. This movement in the opposite direction acts to reduce the impact between recording media S and contact surface 221. The reduction of impact between recording media S and contact surface 221 results in a smaller upward force acting upon feed member 22 and thus the upward position change or shift of feed member 22 caused by the upward force is made small. The upward position change of feed member 22 causes a flexion in shaft 21, and this will result in an oscillation of feed member 22. However, in this exemplary embodiment, because the impact between recording media S and feed member 22, and hence the upward force acting upon feed member 22, is reduced by the buffer mechanism, the oscillation of feed member 22 is also reduced.

Thus, the buffer mechanism in lever member 25 suppresses or dampens the oscillation (or spring-back) of feed member 22 compared with a case where such a buffer mechanism is absent. If the oscillation of feed member 22 were large, the distance between feed member 22 and recording media S could fluctuate to such an extent that a space is created therebetween, and thus a possibility of multiple feeding of sheets of recording media S (a phenomenon of feeding multiple recording media at a time when only a single recording medium is to be fed) would become high. Also, the reduction of impact of recording media S upon contact surface 221 acts to lower the volume of sound generated by the impact.

It is to be noted that a variety of structures for providing play in the rotational movement of arm 252 can be conceived.

Figure 9A:
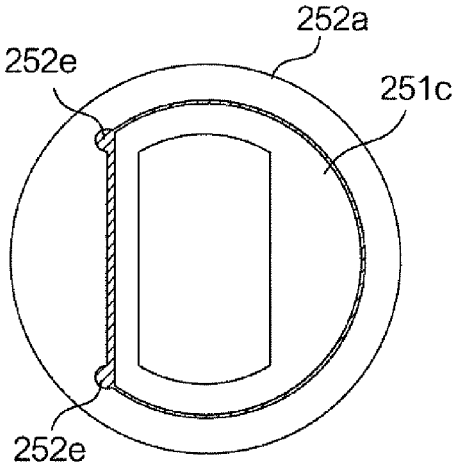
FIGS. 9A and 9B show other examples of the buffer mechanism.
Figure 9B:
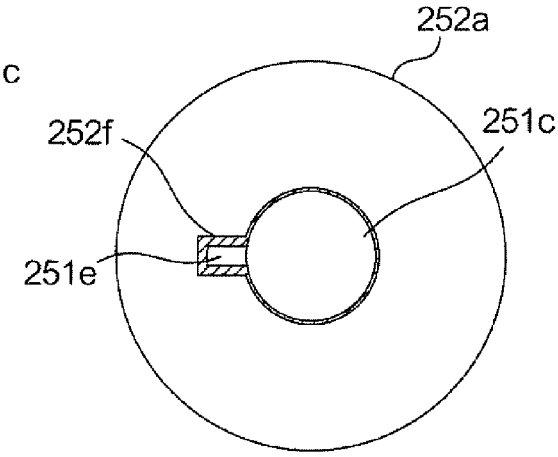

FIGS. 9A and 9B show other examples of buffer mechanism of the exemplary embodiment. FIG. 9A shows an example in which a relief groove 252*e* is formed at each intersection between the arc and chord portions of the boundary of hole 252*c* of arm 252. Relief groove 252*e* accommodates a corner part of tip portion 251*c* of cam follower 251 formed between the arc and chord portions of tip portion 251*c*, thereby to increase the tolerable range of rotational position change of arm 252 relative to cam follower 251. FIG. 9B shows an example in which, instead of the configuration with a gap provided between chord portions of hole 252*c* and tip portion 251*c*, pin 251*e* is fixedly provided on an outer circumference of tip portion 251*c*, and groove 252*f* that receives pin 251*c* is formed in an inner circumference of the hole of arm 252. Groove 252*f* has a somewhat larger size than pin 251*e* to compensate for the relative rotational movement between cam follower 251 and arm 252. Conversely, a pin may be fixedly provided to arm 252 and a groove may be provided to tip portion 251*c*.

[Second Exemplary Embodiment]

The second exemplary embodiment of the present invention differs from the first exemplary embodiment with respect to the structure of the buffer mechanism, and other parts including the image-forming unit, etc., are substantially the same as those in the first exemplary embodiment. Therefore, in the following description of the secondary exemplary embodiment, explanation of such common parts is omitted where appropriate.

Figure 10:
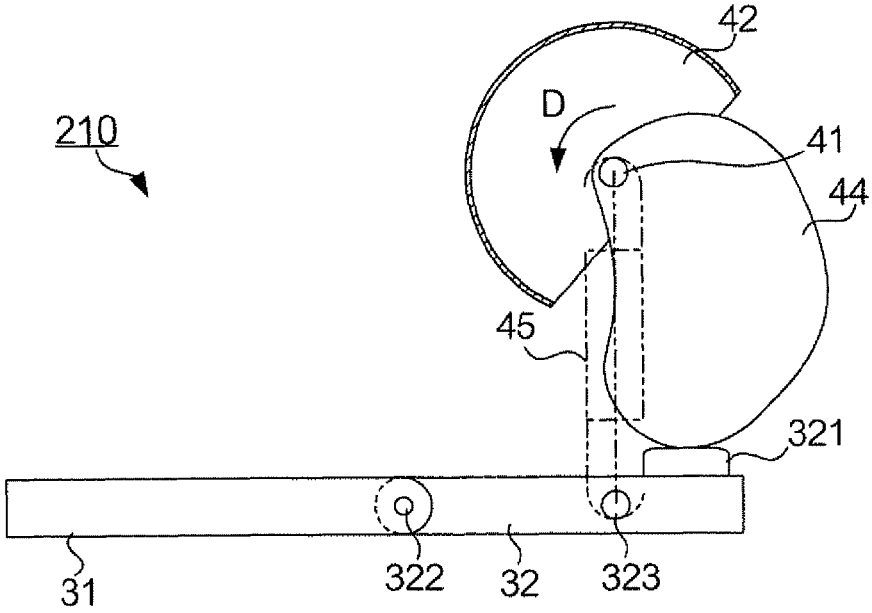
FIG. 10 shows the configuration of the first conveying unit according to a second exemplary embodiment of the invention.

FIG. 10 shows the structure of first conveying unit 210 according to the second exemplary embodiment. As shown in the drawing, first conveying unit 210 of this exemplary embodiment includes plate-shaped members 31, 32, shaft 41, feed member 42, cam member 44, and expandable and contractible unit 45. It is to be noted that, though not shown in FIG. 10, an auxiliary member is attached to shaft 41 as in the first exemplary embodiment. Plate-shaped member 32 is an example of a support member, and is configured to move upward and downward in accordance with the timing of conveying of the recording medium. Plate-shaped member 32 has protruding contact portion 321 and shaft portions 322, 323. Plate-shaped member 32 contacts cam member 44 at contact portion 321, and rotates about shaft portion 322 in response to the rotation of cam member 44. Shaft portion 322 is fitted into a bearing provided to plate-shaped member 31. Thus, plate-shaped member 32 is attached to plate-shaped member 31 at an end portion thereof provided with shaft portion 322, and can rotate about shaft portion 322 upward and downward. Shaft 41 is a rod-shaped member that is rotated by a drive unit (not shown in the drawing) when the supplying of a recording medium is carried out. The direction of rotation of shaft 41 is indicated by arrow D in FIG. 10.

Cam member 44 functions to move plate-shaped member 32 supporting recording media thereon to a lower position so that the recording media do not contact feed member 42. On the other hand, expandable and contractible unit 45 functions to move plate-shaped member 32 supporting recording media thereon to an upper position so that the recording media contact feed member 42. Expandable and contractible unit 45 is an example of a position-changing unit in this exemplary embodiment. It is to be noted that when cam member 44 moves plate-shaped member 32 to the lower position, cam member 44 serves as a means for preventing expandable and contractible unit 45 from moving plate-shaped member 44 to the upper position. In this exemplary embodiment also, the position of plate-shaped member 32 where the conveying of recording media is carried out is referred to as a "conveying position" and the position of plate-shaped member 32 where the conveying of recording media is not carried out is referred to as "non-conveying position."

Figure 11:
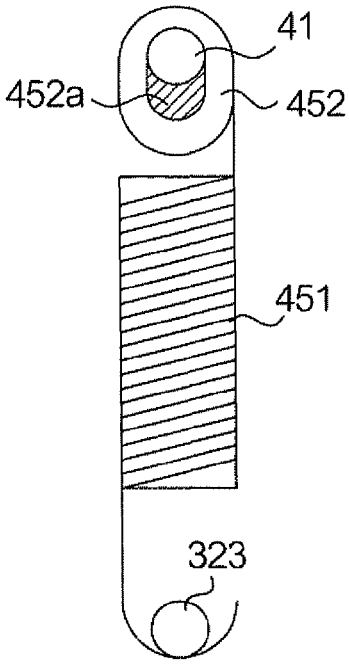
FIG. 11 shows a configuration of an expandable and contractible unit.

FIG. 11 shows the structure of expandable and contractible unit 45. Expandable and contractible unit 45 has coil spring 451 and bearing 452. One end of coil spring 451 is connected to bearing 452 and the other end of coil spring 451 is connected to plate-shaped member 32. Coil spring 451 is a so-called tension spring, and generates an elastic force for urging plate-shaped member 32 upward, thereby to cause plate-shaped member to move from the non-conveying position to the conveying position according to the rotation of cam member 44.

Bearing 452 has hole 452*a* into which shaft 41 is inserted. Hole 452*a* is an elongated hole designed in such a manner that a clearance is created when circular shaft 41 is inserted thereinto. This clearance serves to tolerate up and down movements of expandable and contractible unit 45 within a predetermined range. In other words, expandable and contractible unit 45 includes a buffer mechanism in this exemplary embodiment. The buffer mechanism in this exemplary embodiment operates to suppress or dampen the oscillation of feed member 42 caused by an impact of the recording media on feed member 42.

It should be noted that the buffer mechanism of this exemplary embodiment may be provided on a side of expandable and contractible unit 45 that engages plate-shaped member 32 instead of on a side of expandable and contractible unit 45 that engages shaft 41. In the case where a buffer mechanism is provided on the side of expandable and contractible unit 45 that engages plate-shaped member 32, it is possible, for example, to provide a bearing to this side of expandable and contractible unit 45 to receive a shaft-shaped protrusion provided to plate-shaped member 32. In this case, when plate-shaped member 32 is moved upward, a movement of plate-shaped member 32 in the opposite direction (i.e., downward direction) is tolerated within a predetermined range.

[Modified Embodiment]

The above-described exemplary embodiments are mere examples of the present invention. The present invention is not limited to these exemplary embodiments, and may be practiced according to modified embodiments described in the following. Also, the following modified embodiments may be used in combination, as necessary.

(First Modified Embodiment)

Instead of the buffer mechanism that provides play in the movement of the position-changing unit or support member, it is possible to utilize a structure that generates a force for pressing the rotation member toward the support member. This structure may be used in addition to the above-described structure according to the first or second exemplary embodiment.

Figure 12A:
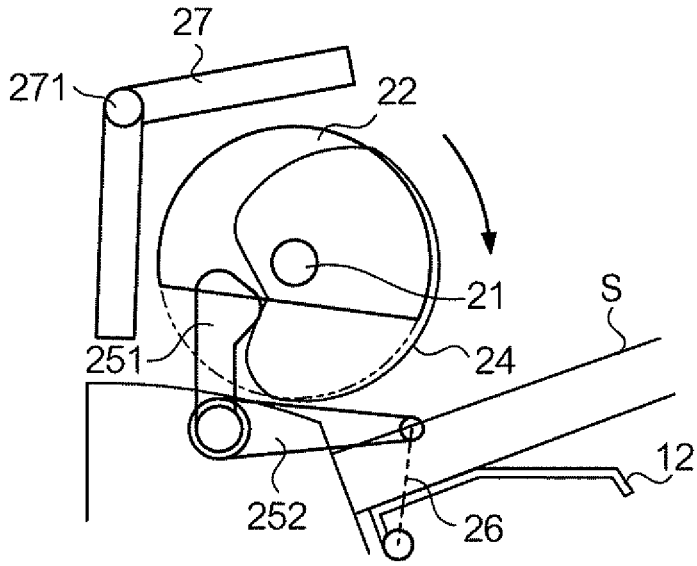
FIGS. 12A and 12B show a configuration and an operation of a stopper according to a modified embodiment of the invention.
Figure 12B:
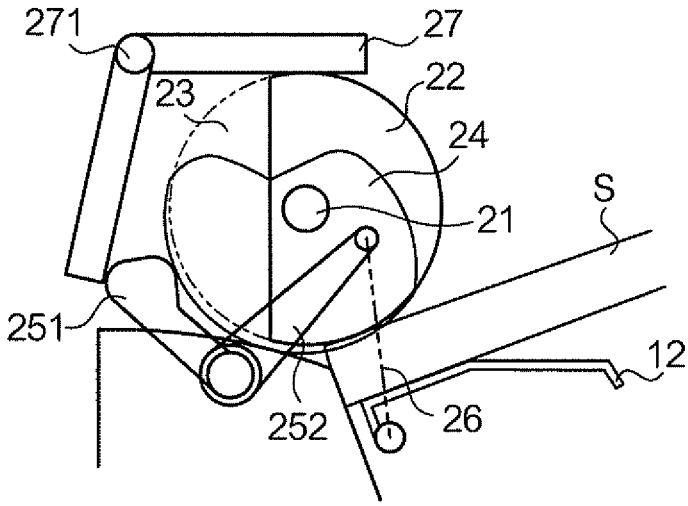

FIGS. 12A and 12B show a modified embodiment in which a structure for pressing the rotation member toward the support member (or a force applying unit) is added to the first exemplary embodiment. In this modified embodiment, the structure for pressing the rotation member toward the support member includes stopper 27 that operates in cooperation with lever member 25. Stopper 27 is a member configured to be rotatable about a shaft portion 271 and has such a shape that when plate-shaped member 12 is at the non-conveying position, stopper 27 does not contact feed member 22 as shown in FIG. 12A, and when plate-shaped member 12 is at the conveying position, stopper 27 is rotated as a result of contact with cam follower 251 of lever member 25 so as to be in contact with auxiliary member 23 as shown in FIG. 12B. Stopper 27 provides auxiliary member 23 with a downward force (or a force in a direction opposite to the direction of force for urging plate-shaped member 12 to the conveying position), thereby to suppress flexion of shaft 21 and hence oscillation of feed member 22.

The force generated by stopper 27 for pressing down auxiliary member 23 has a correlation with a rotation speed of shaft 21. Specifically, the pressing force tends to be larger as shaft 21 rotates faster. On the other hand, the force applied on feed member 22 by an impact of the recording media supported by plate-shaped member 12 also has a correlation with the rotation speed of shaft 21, and tends to be larger as shaft 21 rotates faster. Thus, stopper 27 operates in conjunction with the rotation of shaft 21 in such a manner that the force exerted by stopper 27 for pressing down auxiliary member 23 becomes larger as the conveying speed of recording media increases and feed member 22 becomes easier to oscillate, whereby the oscillation of feed member 22 is effectively suppressed.

(Second Modified Embodiment)

The application of the present invention is not limited to a so-called "manual feeding" conveying device. For example, the present invention may be applied to the above-described second conveying unit 120.

Also, the conveying device according to the present invention is not limited to one that supplies conveyed media to an image-forming unit. The present invention can be applied not only to an image-forming apparatus but also to a variety of other apparatuses that require successive one-by-one feeding of stacked conveyed media or, in other words, require prevention of multi feeding. For instance, the present invention can be utilized in classifying or sorting of the conveyed media.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveying device comprising:

a support member that supports a conveyed medium;

a rotation member that is rotated by a drive unit, the rotation member having a contact surface for contacting the conveyed medium supported by the support member to cause the conveyed medium to move on rotation of the rotation member;

a position-changing unit that changes a position of the support member in accordance with the rotation of the rotation member from a first position where the conveyed medium does not contact the contact surface to a second position where the conveyed medium contacts the contact surface;

a buffer mechanism that allows movement of the position-changing unit or the support member in a direction opposite to a direction of a position change of the support member from the first position to the second position caused by the position-changing unit;

a force applying unit that applies a force on the rotation member to urge the rotation member toward the support member when the position-changing unit changes the position of the support member from the first position to the second position;

a shaft member that is rotated by the drive unit; and a cam member that rotates with the shaft member, wherein the rotation member rotates with the shaft member, and the force applying unit comprises a stopper that generates a force urging the rotation member toward the support member when the support member undergoes the position change from the first position to the second position, and wherein the position-changing unit comprises:

a position-changing member that contacts the cam member and changes the position of the stopper in accordance with the rotation of the cam member when the support member undergoes the position change from the first position to the second position; and an elastic member having a first end attached to the position-changing member and a second end attached to the support member to generate an elastic force for moving the support member from the first position to the second position in accordance with the rotation of the cam member.

2. An image-forming apparatus comprising the conveying device according to claim 1, the image-forming apparatus further comprising an image-forming unit that forms an image on the conveyed medium supplied from the conveying device.

* * * * *